United States Patent [19]

Kronberger, Jr.

[11] 4,139,152

[45] Feb. 13, 1979

[54] HEATING SYSTEM

[76] Inventor: Joseph A. Kronberger, Jr., R.D. #2, Williamstown Rd., Franklinville, N.J. 08322

[21] Appl. No.: 784,934

[22] Filed: Apr. 5, 1977

[51] Int. Cl.[2] ..... F24D 3/08

[52] U.S. Cl. ..... 237/8 R; 237/63; 126/132

[58] Field of Search ..... 126/132, 400; 237/8 R, 237/8 C, 51, 63, 1 A; 165/DIG. 2

[56] References Cited

U.S. PATENT DOCUMENTS

| | | | |
|---|---|---|---|
| 1,992,251 | 2/1935 | Stewart | 237/8 R |
| 2,813,683 | 11/1957 | Dillman | 237/8 C |
| 3,107,052 | 10/1963 | Garrison | 237/1 A |
| 3,958,755 | 5/1976 | Cleer, Jr. | 126/132 X |
| 4,025,043 | 5/1977 | Cleer, Jr. | 126/132 X |
| 4,044,949 | 8/1977 | Morawetz et al. | 237/1 A |
| 4,046,320 | 9/1977 | Johnson et al. | 126/132 X |
| 4,049,194 | 9/1977 | Tice et al. | 237/1 A |
| 4,052,001 | 10/1977 | Vogt | 237/8 R X |

FOREIGN PATENT DOCUMENTS

| | | | |
|---|---|---|---|
| 113849 | 3/1918 | United Kingdom | 126/132 |

*Primary Examiner*—William E. Wayner
*Assistant Examiner*—William E. Tapolcai, Jr.
*Attorney, Agent, or Firm*—Duffield & Lehrer

[57] ABSTRACT

A water filled coil in the rear of a fireplace is connected to a hot water storage tank so that heated water in the coil can circulate into the tank. A second hot water storage tank is connected to the first storage tank and an aquastat associated with the first tank controls the flow of water between the two tanks. Heat exchanger coils within the two storage tanks are used to preheat incoming cold water before it is fed to a domestic hot water heater. Another heat exchanger coil within the second storage tank is interconnected with the main baseboard hot water heating system and furnace. Automatic bypass valves and aquastats are adapted to turn the furnace off and utilize the heat exchanger coil when the fireplace is providing sufficient hot water and are adapted to fire the furnace and bypass the heat exchanger coil when insufficient heat is provided by the fireplace.

3 Claims, 3 Drawing Figures

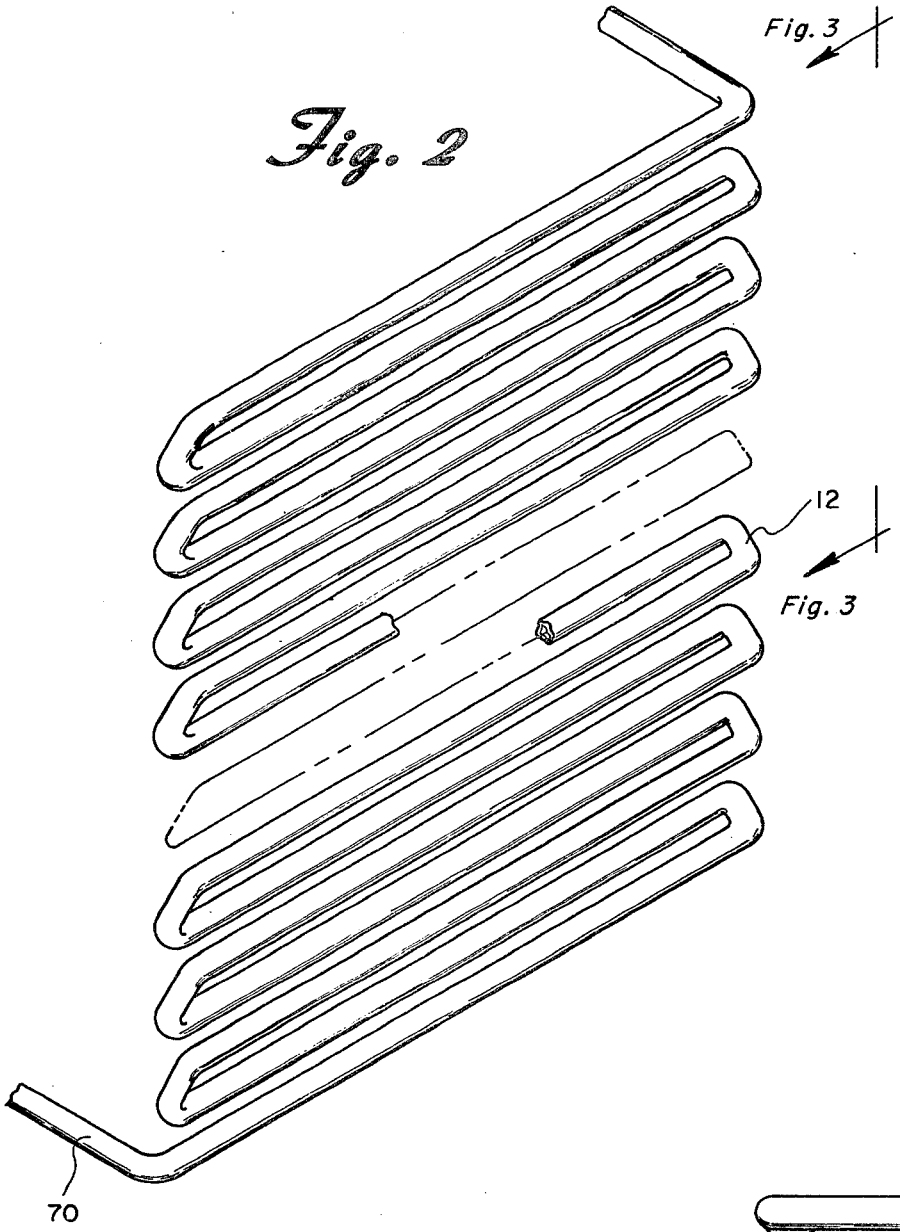
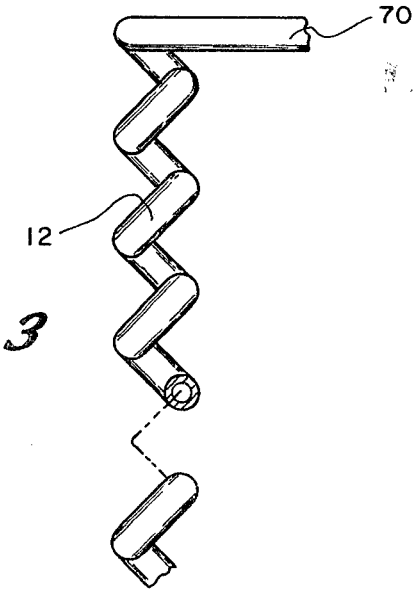
Fig. 3

HEATING SYSTEM

BACKGROUND OF THE INVENTION

The present invention is directed toward a heating system and more particularly toward a hot water heating system which utilizes heat from a fireplace to replace or supplement heat from a furnace. The heat from the fireplace is also used to preheat water entering the domestic hot water heater.

Attempts have been made to utilize heat from a fireplace for heating rooms in a house which are remote from the room wherein the fireplace is located. These prior attempts have included hot water systems wherein hot water is heated in the fireplace and transferred to a storage tank where it is circulated through radiators in various rooms in the house. U.S. Pat. Nos. 2,006,279 and 1,576,899 are examples of such prior art systems.

One of the main difficulties with such prior art systems is that the same water that is heated in the fireplace is used in the home heating system. Thus, if there is a problem in any part of the system, the entire system must be shut down. In other words, if the fireplace heating coil became defective, the entire home heating system would have to be shut down until it could be replaced.

SUMMARY OF THE INVENTION

The present system overcomes this and various other problems encountered with the prior art devices by including at least one storage tank and a heat exchange coil. Preferably, there are two hot water storage tanks. The water filled coil in the rear of the firplace is connected to one of the storage tanks so that heated water in the coil can circulate into the tank. The second storage tank is connected to the first storage tank and an aquastat associated with the first tank controls the flow of water between the two tanks. Heat exchanger coils within the two storage tanks are used to preheat incoming cold water before it is fed to the domestic hot water heater. Another heat exchanger coil within the second storage tank is interconnected with the main baseboard hot water heating system and furnace. Automatic bypass valves and aquastats are adapted to turn the furnace off and utilize the heat exchanger coil when the fireplace is providing sufficient hot water and are adapted to fire the furnace and bypass the heat exchanger coil when insufficient heat is provided by the fireplace.

BRIEF DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

FIG. 2 is a perspective view of a fireplace heating coil employed with the present invention, and FIG. 3 is a schematic representation of a side view of part of the coils shown in FIG. 2 and taken along the line 3—3.

DETAILED DESCRIPTION OF THE PREFERRED EMBODIMENT

Figure 1:
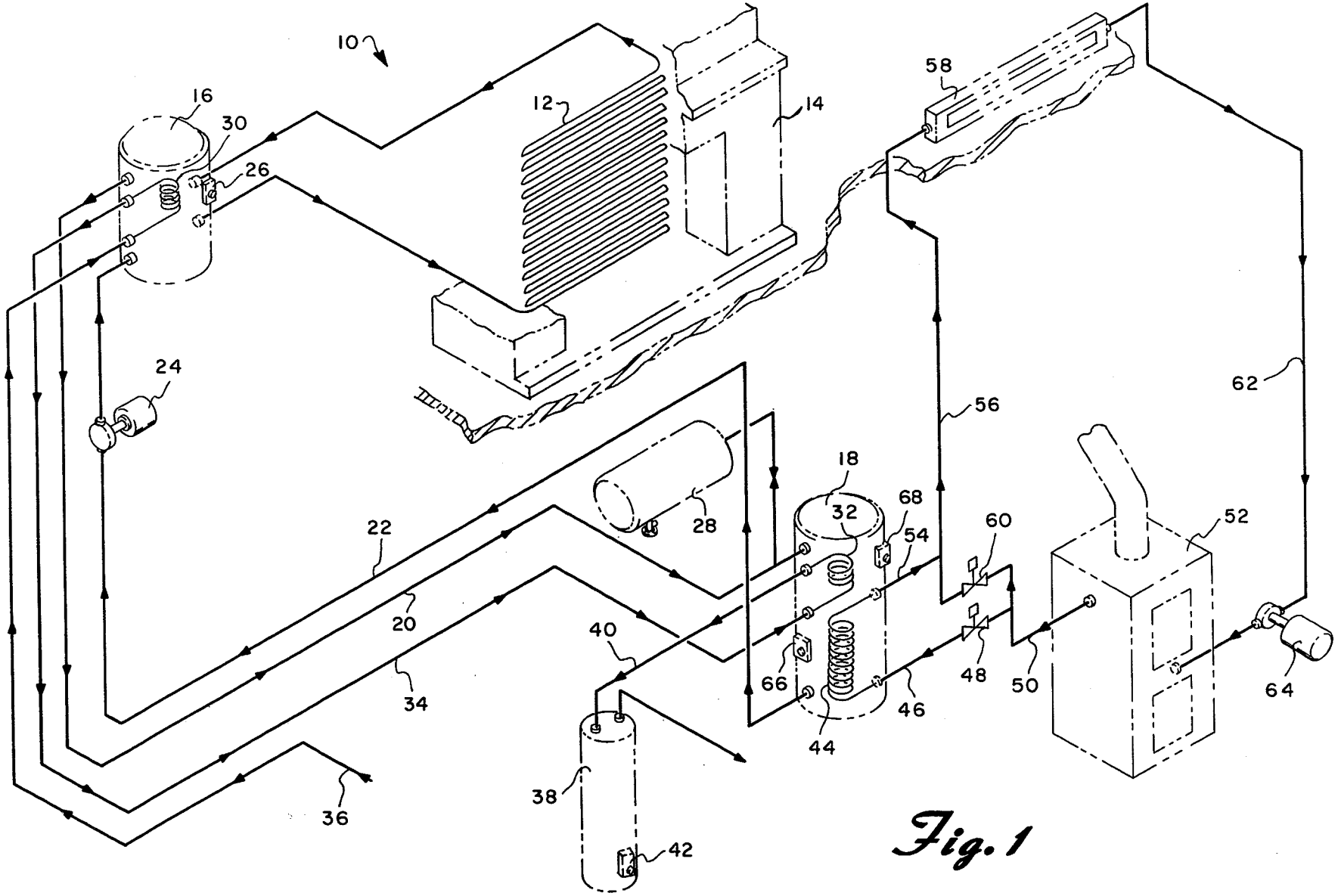
FIG. 1 is a schematic representation of a heating system constructed in accordance with the principles of the present invention.

Referring now to the drawings in detail there is shown in FIG. 1 a schematic representation of a heating system constructed in accordance with the principles of the present invention and designated generally as 10. Heating system 10 includes a pipe coil 12 (the details of which will be described more fully hereinafter) which is mounted on the rear wall of fireplace 14 so that the water in the pipe coil 12 can be heated by any heat in the fireplace.

Coil 12 is connected to a primary hot water storage tank 16. As shown, the upper part of coil 12 is connected to the upper part of tank 16 and the lower part of coil 12 is connected to the lower portion of tank 16. In this way, convection currents cause the water to flow through the coil 12 and tank 16 and a circulating pump is not necessary.

A second water storage tank 18 is located remote from the primary storage tank 16, preferably in the area of the existing home heating system. Hot water storage tanks 16 and 18 are connected together through lines 20 and 22. A circulating pump 24 controlled by an aquastat 26 associated with hot water storage tank 16 controls the flow of water between tanks 16 and 18. An expansion tank 28 may also be connected in a conventional manner to one of the lines such as line 20 between tanks 16 and 18.

Located within hot water storage tanks 16 and 18 are heat exchange coils 30 and 32. Heat exchange coils 30 and 32 are connected in series through lines 34. Incoming cold water from a city water line or well is fed to heat exchange coil 30 through line 36. This water is heated within heat exchange coil 30 by the heat of the water in storage tank 16, then passes via line 34 to heat exchange 32 where it is further heated by the hot water in tank 18. From there, the water flows into a conventional domestic hot water heater 38 via line 40. Thus, it can be seen that incoming city water or well water is substantially preheated by the present system before it flows into the domestic hot water heater 38. As a result, hot water heater 38 controlled by aquastat 42 should seldom, if ever, turn on as long as there is a fire in the fireplace 14.

Also located within hot water storage tank 18 is a second and larger heat exchange coil 44. The lower end of heat exchange coil 44 is connected via line 46 to one side of an electrically controlled valve 48. The other side of valve 48 is connected to the upper part of line 50 of a gas or oil fired hot water furnace 52.

The upper end of heat exchange coil 44 is connected via line 54 to a line 56 which feeds the hot water radiators such as radiator 58 throughout the house. A second electrically controlled valve 60 is also connected between the junction of lines 54 and 56 and line 50 from the furnace 52. Water returns from radiator 58 through line 62 and circulating pump 64 in the conventional manner.

Hot water storage tank 18 also includes a pair of aquastats 66 and 68. Aquastat 66 controls the gas valve or oil burner of furnace 52 and aquastat 68 controls valves 48 and 60 in the hot water lines.

The system just described operates in the following manner. Water within coil 12 is heated by the fire in the fireplace 14 and by convection flows to tank 16. When the temperature of the water within tank 16 reaches a desired level, circulating pump 24 pumps the water from tank 16 into tank 18. The hot water in the tanks 16 and 18, as explained above, is used to preheat incoming city water or well water which passes through heat exchange coils 30 and 32 before it flows to the domestic hot water heater 38.

When the water within tank 18 is at a predetermined sufficiently high temperature, aquastat 66 maintains the furnace 52 off. In addition, aquastat 68 closes valve 60 and opens valve 48. Circulating pump 64, controlled by the home thermostat, will, therefore, circulate water from heat exchange coil 44 through lines 54 and 56 to radiator 58 and back through line 62, through furnace 52 and line 50 to valve 48, line 46 and heat exchange coil 44. Water will continue to circulate in this manner.

In the event that the temperature of the water within the tank 18 drops thereby preventing the water within heat exchange coil 44 from reaching its proper heating temperature, aquastat 66 may turn the burners of furnace 52 on which will then provide further supplemental heat to the hot water heating system. At the desired temperature of the water within tank 18, aquastat 68 may also close valve 48 and open valve 60 thereby totally eliminating the supplemental heating system of the present invention and essentially returning the preexisting furnace and heating system to its conventional operation. It has been found, however, that as long as a fire is maintained in fireplace 14, furnace 52 rarely, if ever, has to be turned on.

As shown in FIG. 2, the fireplace heating coil 12 of the present invention is comprised essentially of the multi-folded tubular pipe 70. Pipe 70 is preferably a ¾ inch carbon steel pipe. However, various other materials and sizes may be utilized. The total length of the pipe is approximately 60 feet.

As shown most clearly in FIG. 3, the pipe is arranged in essentially a zigzag fashion as it goes back and forth across the rear fireplace wall. In other words, the coil does not lie in a single plane. As a result of this arrangement, more surface area is exposed and heat is prevented from passing too quickly past the coil 12 and up the chimney. Thus, the pipe arrangement captures more heat than would an arrangement wherein all of the pipes lie substantially in the same plane.

The present invention may be embodied in other specific forms without departing from the spirit or essential attributes thereof and, accordingly, reference should be made to the appended claims, rather than to the foregoing specification as indicating the scope of the invention.

I claim:

1. A heating system comprising:

a heating coil located within a fireplace and a fluid within said heating coil, said fluid and coil being adapted to be heated by a fire within said fireplace;

fluid storage means, said fluid storage means being in fluid communication with said heating coil;

a first heat exchange means located within said fluid storage means, said first heat exchange means being adapted to contain water therein and being adapted to be connected to a hot water heating system;

means for circulating water through said first heat exchange means and said hot water heating system, and a second heat exchange means within said fluid storage means, said second heat exchange means having a first end adapted to be connected to an incoming water line and a second end adapted to be connected to the input of a hot water heater whereby water from said incoming water line is preheated within said storage means before it flows into said hot water heater.

2. A heating system comprising:

a heating coil located within a fireplace and a fluid within said heating coil, said fluid and coil being adapted to be heated by a fire within said fireplace;

a first fluid storage means, said first fluid storage means being in fluid communication with said heating coil;

a heat exchange means located within said first fluid storage means, said heat exchange means being adapted to contain water therein and being adapted to be connected to a hot water heating system;

means for circulating water through said heat exchange means and said hot water heating system, and a second fluid storage means, said second storage means being in fluid communication with said first storage means and means for circulating fluid between the two said storage means.

3. A heating system comprising:

a heating coil located within a fireplace and a fluid within said heating coil, said fluid and coil being adapted to be heated by a fire within said fireplace;

fluid storage means, said fluid storage means being in fluid communication with said heating coil;

a heat exchange means located within said fluid storage means, said heat exchange means being adapted to contain water therein and being adapted to be connected to a hot water heating system;

means for circulating water through said heat exchange means and said hot water heating system;

a hot water furnace means, and valve means adapted to selectively bring said heat exchange means in series with said furnace means and said hot water heating system and to remove said heat exhange means from said furnace means and said hot water heating system.

* * * * *